US006948954B1

(12) United States Patent
Fan

(10) Patent No.: US 6,948,954 B1
(45) Date of Patent: Sep. 27, 2005

(54) ELECTRICAL CONNECTOR ASSEMBLY

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/028,029

(22) Filed: Dec. 31, 2004

(30) Foreign Application Priority Data

Jun. 4, 2004 (TW) ..... 93116043 A

(51) Int. Cl.[7] ..... H01R 13/44
(52) U.S. Cl. ..... 439/137; 439/607
(58) Field of Search ..... 439/135, 137, 439/138, 139, 140, 142, 607, 108

(56) References Cited

U.S. PATENT DOCUMENTS

| | | | | |
|---|---|---|---|---|
| 6,832,923 | B2 * | 12/2004 | Sasame et al. | 439/137 |
| 2001/0031570 | A1 * | 10/2001 | Horikoshi et al. | 439/137 |
| 2002/0177336 | A1 | 11/2002 | Sasame | |
| 2003/0077929 | A1 | 4/2003 | Funatsu | |
| 2003/0148645 | A1 * | 8/2003 | Hashimoto | 439/137 |
| 2004/0092145 | A1 | 5/2004 | Sasame | |

FOREIGN PATENT DOCUMENTS

| | | |
|---|---|---|
| JP | 2000-36355 | 2/2002 |
| TW | 487234 | 5/2002 |
| TW | 557003 | 10/2003 |

* cited by examiner

*Primary Examiner*—Hien Vu
(74) *Attorney, Agent, or Firm*—Wei Te Chung

(57) ABSTRACT

An electrical connector assembly (1) comprises a receptacle connector (2) and a plug connector (3) to be connected to the receptacle connector (2). The receptacle connector (2) comprises a first insulating case (4) including a first base portion (41) having a plug fitting section (411), a pair of neck portions (42) and a pair of wall portions (43), a plurality of first electrical contacts (23) received in the first insulating case (4) and a pair of shutter members (21) mounted on the first insulating case (4) comprising a pair of shutter member halves **(21*a*, 21*b*). The plug connector (3) comprises a second insulating case (6) provided with a pair of separate guide devices (63) on opposite ends and a pair of separate receiving spaces (423) and a plurality of second electrical contacts (33) received in the second insulating case (6)**.

10 Claims, 10 Drawing Sheets

ELECTRICAL CONNECTOR ASSEMBLY

BACKGROUND OF THE INVENTION

1. Field of the Invention

The present invention relates to an electrical connector assembly, more particular, to an electrical connector assembly that has means for preventing dust and dirt from entering into it.

2. Description of Related Art

In order to achieve power or signal transmission, various kinds of electrical connectors are generally used to connect internal components within electrical devices and connect an electrical device with other devices. However, in untidy condition, especially when electrical connectors are not fitted, dust and dirt may enter into the electrical connector to adversely effect against power or signal transmission.

At present, in order to solve the above-mentioned problem, a shutter member is designed on a plug fitting section of a connector. U.S. patent application Pub. No. 2003/0077929 discloses a receptacle connector with a shutter member and a plug connector with a pair of responding guide pins of taper-shaped to open the shutter member. The guide pins provided in opposite ends of a plug fitting section of the plug connector enter through-holes of the receptacle connector to drive the shutter member to be opened. However, the guide pins not only guide the plug connector but also drive the shutter member and at last enter into the plug fitting section, therefore, the transverse width of the guide pins is smaller. That is to say, the change of angle by the shutter member being opened is smaller. As a result, time of connecting is longer.

Another electrical connector assembly with a shutter member is described in U.S. patent application Pub. No. 2002/0177336. Cams of the shutter member increase the transverse width, so the above problem is partly sloved. However, when the plug connector is connected to the receptacle connector, the guide pins can not well open the shutter member to cause the shutter member easily suffer from malfunction and destruction.

Therefore, it is desirable to provide an electrical connector assembly to overcome the above problems.

SUMMARY OF THE INVENTION

The object of the present invention is to provide an electrical connector assembly, which can quicken opening of a shutter member and prevent the shutter member from blocking by a plug connector and suffering destruction.

In order to achieve the object set forth, the electrical connector assembly according to the present invention comprises a receptacle connector and a plug connector to be connected to the receptacle connector. The receptacle connector comprises a first insulating case including a first base portion having a first fitting section, a pair of neck portions extending from opposite ends of the first base portion and a pair of wall portions extending from the pair of neck portions. A plurality of first electrical contacts received in the first insulating case and a shutter member mounted on the first insulating case comprising a pair of shutter halves provided with openings on opposite ends thereof for mating with two receiving spaces formed between the pair of wall portions and the first base portion for a width of the neck portion perpendicular to the longitudinal direction is smaller than a corresponding width of the first base portion. The plug connector comprises a second insulating case provided with guide devices on opposite ends thereof inserted into the pair of openings and the pair of receiving spaces and a plurality of second electrical contacts received in the second insulating case.

The detailed features of the present invention will be apparent in the detailed description with appropriate reference to the accompanying drawings.

DETAILED DESCRIPTION OF THE INVENTION

The present invention is now described in detail.

Figure 1:
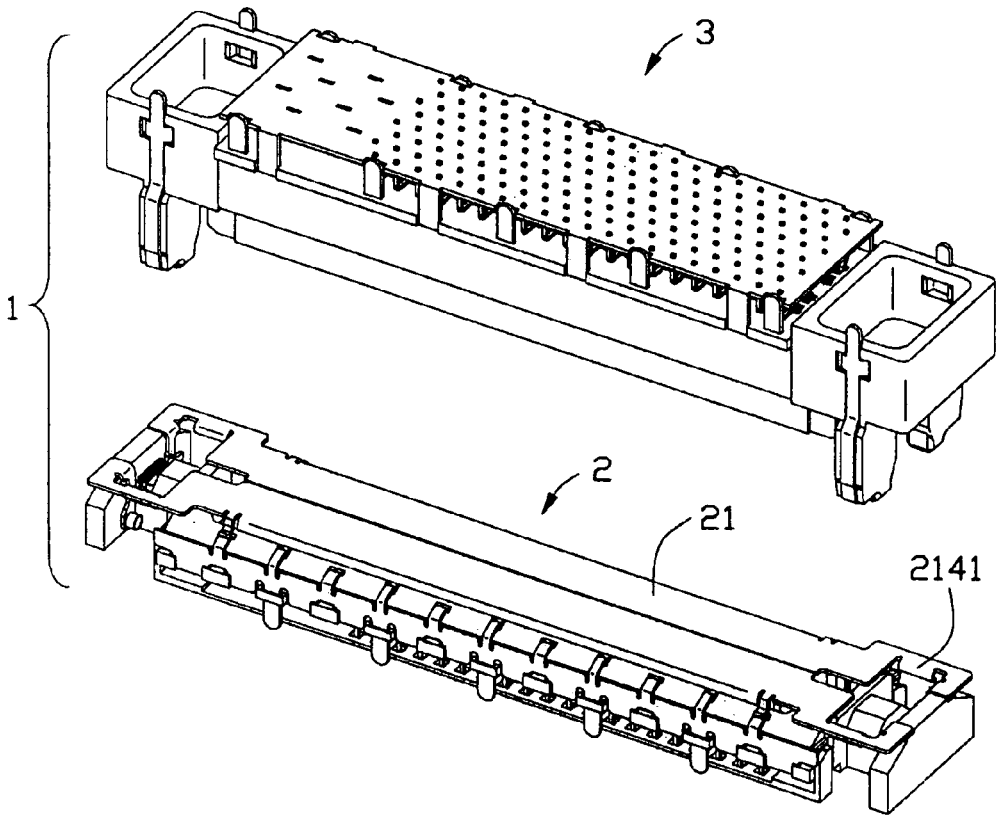
FIG. 1 is a perspective view of an electrical connector assembly according to a first embodiment of the present invention before connection.

In FIGS. 1–9, an electrical connector assembly 1 according to a first embodiment of the present invention comprises a receptacle connector 2 and a plug connector 3 to be connected to the receptacle connector 2. As shown in FIG. 1, the receptacle connector 2 provides a shutter member 21 in order to prevent dust and dirt from entering into the receptacle connector 2.

Figure 2:
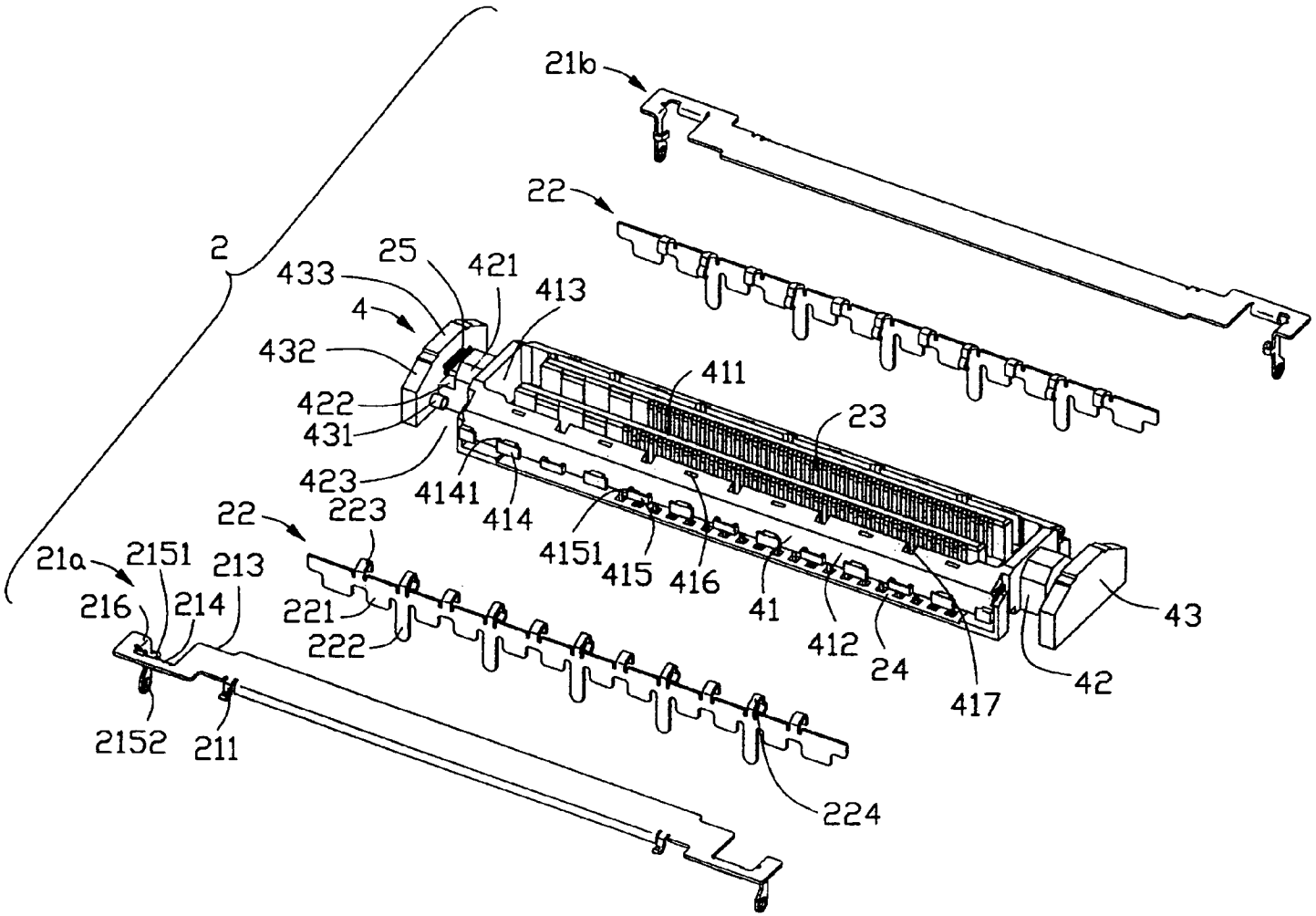
FIG. 2 is an exploded perspective view of a receptacle connector of the electrical connector assembly in FIG. 1.
Figure 4:
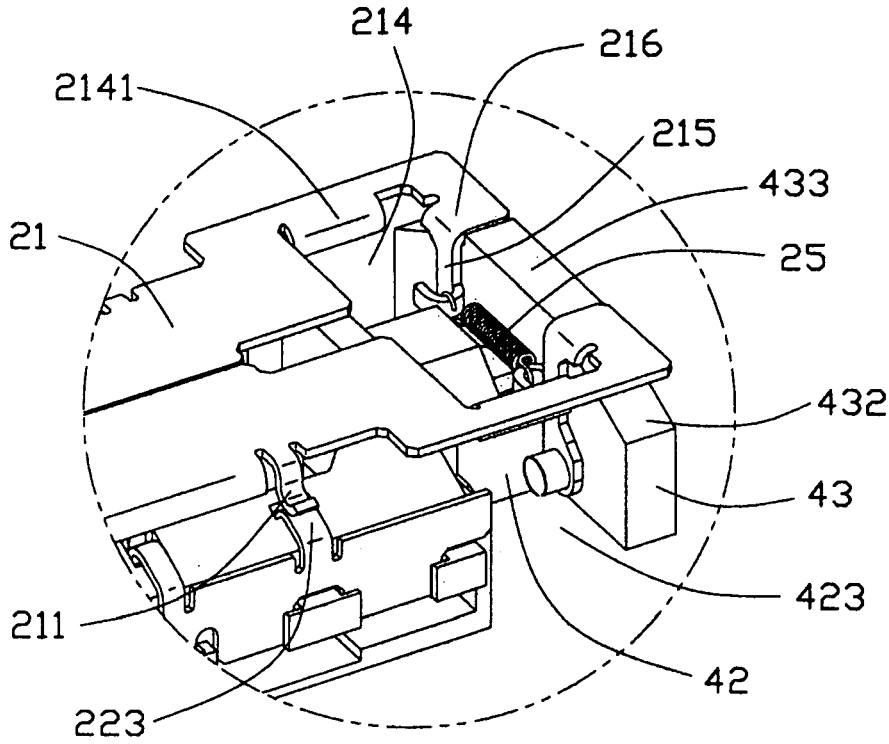
FIG. 4 is a partially enlarged perspective view of the receptacle connector in FIG. 2, but taken from another aspect.

As shown in FIGS. 2 and 4, the receptacle connector 2 comprises a first insulating unitary elongate case 4, a pair of first shielding covers 22 mounted on the outer periphery of the first insulating case 4 and a shutter member 21. The first insulating case 4 comprises a first base portion 41, a pair of neck portions 42 extending from opposite ends of the first base portion 41 and a pair of wall portions 43 extending from the pair of neck portions 42. The first base portion 41 is provided with a first bottom board 24 mounted thereon and has a groove along the longitudinal direction of the insulating case 4. The groove has a pair of side walls 412 at opposite sides thereof and a pair of plug fitting section 411 protrude into the groove accommodating a plurality of first electrical contacts 23 at opposite sides thereof. Two separate through-holes 413 are provided at opposite ends of the groove. The plurality of first electrical contacts 23 extends downwards through the first bottom board 24 to connect with a printed circuit board. A plurality of first convexities 414 and a plurality of second convexities 415 are alternatly arranged at intervals along an outer periphery of the pair of side walls 412. The first convexties 414 further comprise blocks 4141 and the second convexities 514 further comprise slots 4154. A gap 416 and a passage 417 are provided on an upper surface of the side walls 412 at intervals along the longitudinal direction. In addition, a top of the neck portion 42 is flanked by a pair of slanted first guide faces 421. A spring 25 is provided in a concave 422 defined between the neck portion 42 and the wall portion 43 and connected with the shutter member 21 to elastically drive the shutter member 21 to close the plug fitting section 411 of the insulating case 4. The wall portion 43 is a board perpendicular to the longitudinal direction. For a width of the neck portion 42 perpendicular to the longitudinal direction is smaller than a corresponding width of the first base portion 41, there is a receiving space 423 defined between the first base portion 41 and the wall portion 43 and adjacent to the neck portion 42. A pair of sliding faces 432 respectively extends downwards from the top of the wall portion 43. Otherwise, a step portion 433 is formed on the top of the sliding face 432 and symmetrically arranged about the central line of the shutter member 21. Two shafts 431 are provided on the wall portion 43 to extend into the receiving space 423 so as to mount the shutter member 21.

Then, referring to FIGS. 2 and 4, the pair of first shielding covers 22 is formed and stamped from a metal sheet and configured in an elongated shape. Each of the first shielding covers 22 comprises a plurality of fixing pieces 221 and a plurality of first grounding pieces 222 extending downwards from a lower edge thereof arranging at intervals, a plurality of contact pieces 223 and elastic contact pieces 224 curving upwards from an upper edge thereof at intervals. When the pair of first shielding covers 22 are mounted on the first base portion 41, the fixing pieces 221 are inserted into a space between the first convexities 414 and the second convexities 415 and are secured by the blocks 4141. At the same time, the first grounding pieces 222 are inserted into the slots 4151 and extend downward to connect with the grounding wire of a printed circuit board, also, the contact pieces 223 are fixed into the gap 416 and the forepart of the elastic contact pieces 224 are received into the passage 417.

The shutter member 21 is mounted to the insulating case and movable with respect to the insulating case to open and close the plug fitting section of the insulating case and the shutter member comprises a pair of shutter member halves 21*a*, 21*b* of metal. As the halves 21*a*, 21*b* are substantially symmetrical, a description will be given of the first half 21*a* with the understanding that the second half 21*b* is of substantially similar configuration. The first half 21*a* comprises a base section. Two separate openings 214 are provided on opposite ends of the base section of the first half 21*a* and two smaller openings 213 are adjacent to the openings 214. For the two separate openings 214 are the same, one opening 214 is described. A guide piece 2141 curves downwards from one side to the opening of the opening 214 (as shown in FIG. 1). A mating arm 215 is extending downwardly from a distal end 216 which is perpendicular to a surface of the base section of the first half 21*a*. Further, a locking portion 2151 protrudes from an edge of the mating arm 215 to the guide piece 2141 and a pivot hole 2152 is provided in free end of the mating arm 215. Otherwise, sliding pieces 211 extend downwardly from one edge of the base section of the first half 21*a*. Specially, the opening direction of the openings 214, 213 is different from the protruding direction of the sliding pieces 211. As shown in FIG. 1, when the pivot hole 2152 of the first half 21*a* is secured on the shaft 431 of the first insulating case 4, the spring 25 is secured with the responding locking portion 2151. Under certain force, the shutter member 21 is able to close and open the plug fitting section 411 of the receptacle connector 2. When the shutter member 21 is closed, the opening formed by the two smaller openings 213 of the shutter member halves 21*a*, 21*b* communicates with the through-hole 413, the opening formed by the two openings 214 of the shutter member halves 21*a*, 21*b* communicates with the receiving space 423. Simultaneously, the distal ends 216 abut against the step portions 433 and the sliding pieces 211 meet the contact pieces 223 of the first shielding covers 22. As a result, dust and dirt can not enter into the plug fitting section 411 to contaminate the first electrical contacts 23. On the other hand, while the shutter members 21 open the plug fitting section 411, the sliding pieces 211 are sliding along the contact pieces 223.

Figure 3:
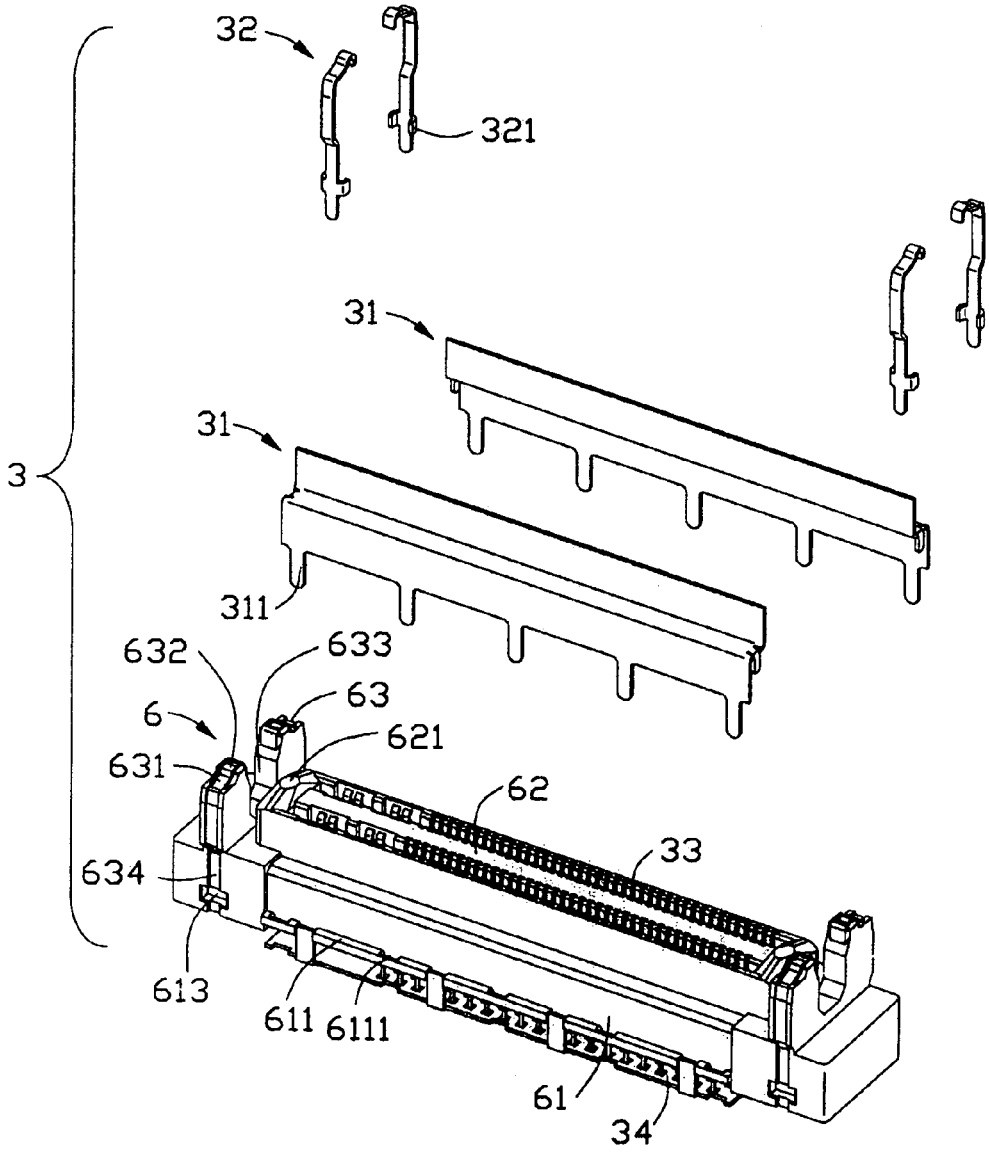
FIG. 3 is an exploded perspective view of a plug connector of the electrical connector assembly in FIG. 1.

Then, referring to FIG. 3, the plug connector 3 consists of a second insulating unitary elongate case 6, a pair of second shielding covers 31 mounted on an outer periphery of the second insulating case 6 and grounding contacts 32. The second insulating case 6 comprise a second base portion 61, a receptacle fitting section 62 extending upwardly from the second base portion 61 and a pair of separate guide devices 63. A plurality of slots 6111 is located on a pair of ribs 611 extruding from opposite sides of the second base portion 61. The receptacle fitting section 62 is provided with a second bottom board 34 mounted thereon and has a groove along the longitudinal direction. The receptacle fitting section 62 protrudes into the groove accommodating a plurality of second electrical contacts 33 at two sides thereof. The plurality of second electrical contacts 33 extends downwardly through the second base portion 61 and the second bottom board 34 to connect with a printed circuit board. Furthermore, a pair of separate guide tapers 621 extends upwardly from opposite ends of the receptacle fitting section 62 to connect with the plug fitting section 411 of the receptacle connector 2. In addition, the guide devices 63 extended from the second base portion 61 are adjacent to the guide tapers 621 at the same direction of the receptacle fitting section 62 and the guide tapers 621. On the other hand, a plurality of second grounding pieces 311 extends downwards from the low edge of the second shielding covers 31 and is inserted into the slots 6111 of ribs 611 of the second base portion 61 so as to connect to the ground.

Figure 5:
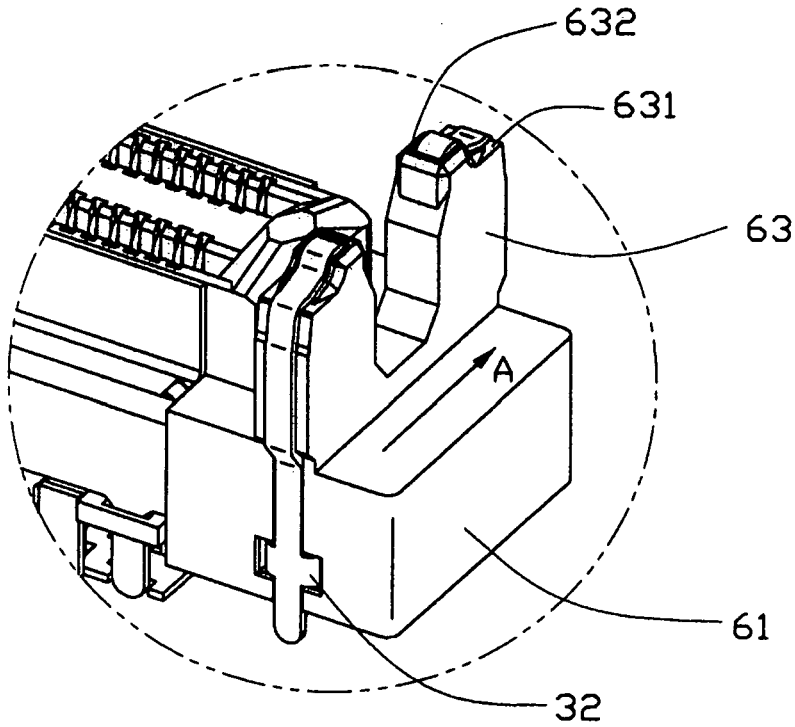
FIG. 5 is a partially enlarged perspective view of the plug connector in FIG. 3, but taken from another aspect.
Figure 6:
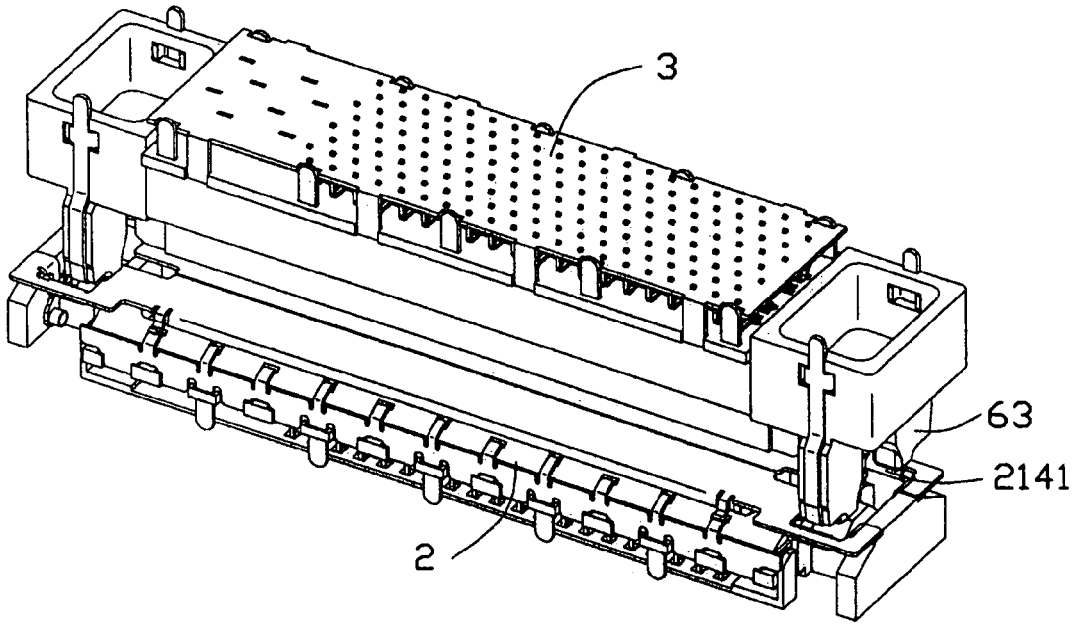
FIG. 6 is a perspective view of the electrical connector assembly showing the plug connector not completely mating with the receptacle connector.
Figure 7:
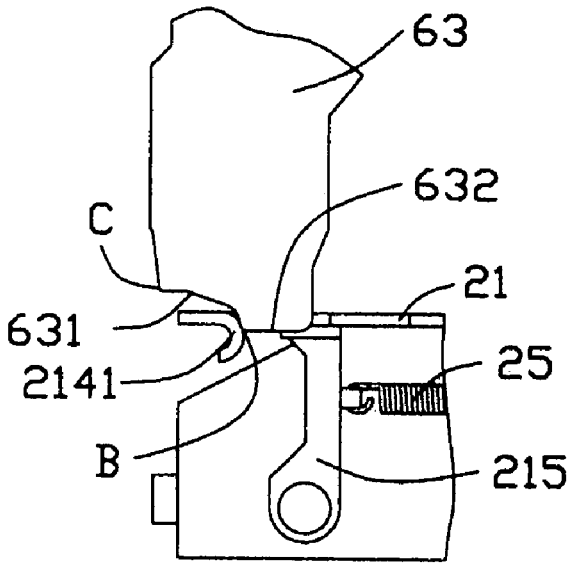
FIG. 7 is a planar view showing guide pins of the plug connector partially entering a shutter member of the receptacle connector.
Figure 8:
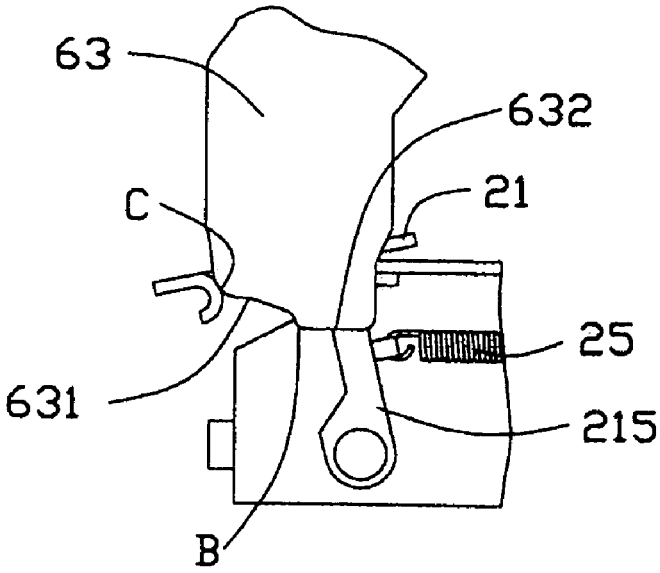
FIG. 8 is a view similar to FIG. 7 showing the guide pins of the plug connector completely entering the shutter member of the receptacle connector.
Figure 9:
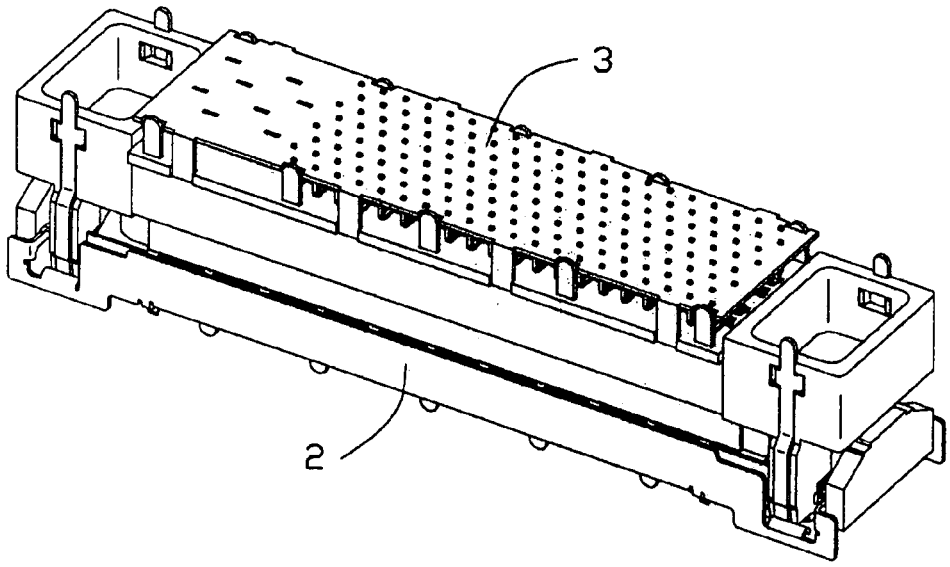
FIG. 9 is a view similar to FIG. 6 showing the plug connector completely mating with the receptacle connector.

As shown in FIGS. 3 and 5, the guide devices 63 is of a saddle shape and engageable with the neck portion 42 upon extending through the opening 214 into the receiving space 423 to drive the shutter member 21 open the plug fitting section 411. Each of the guide devices 63 has a pair of guide columns. The guide columns extend perpendicularly to the direction of the arrow A and arranges symmetrically at a distance. Because the pair of guide columns is the same structure, so one of the guide columns is described. The guide column comprises a peak 632, a slanted second guide face 631, a long groove 634 and an inner surface 633. The second guide face 631 is located in flank of the guide column and slopes up to form the peak 632. Furthermore, the long groove 634 extends from the peak 632 to a bottom of the second base portion 61 and a longitudinal securing portion 613 of the second base portion 61 is provided on the free end of the long groove 634 and the width of which is more than that of the long groove 634. Both the peak 632 and the second guide face 631 are located in the long groove 634. When the grounding contact 32 of metal material is fitted on the second base portion 61, the grounding contact 32 is secured in the long groove 634 and a bender 321 is provided at the free end of the grounding contact 32 and is secured in the longitudinal securing portion 613 of the second base portion 61. On the other hand, the inner surface 633 of the guide column matches with the surface of the neck portion 42 of the first insulating case 4.

Referring to FIGS. 6–9, when the plug connector 3 is plugged into the receptacle connector 2, firstly, the peak 623 of the guide device 63 enters into the opening 214 and contacts the guide piece 2141 at the point of B. At the moment, static electricity of the plug connector 3 and the receptacle connector 2 is released through the grounding contact 32, the guide piece 2141, the sliding piece 211 and the contact piece 223 of the first shielding cover 22. However, in this moment the receptacle fitting section 62 does not contact with the plug fitting section 411 and the second electrical contacts 33 also does not contact with the first electrical contacts 23. Secondly, the second guide face 631 of the guide device 63 slides on the guide piece 2141 to the point of C to drive the mating arm 215 to rotate about the shaft 431 and the spring 25 is elongated at the same time. Meanwhile, the sliding piece 211 slides on the contact piece 223 so that the receptacle fitting section 62 is entirely connected to the plug fitting section 411. Especially, when the guide column of the guide device 63 moves to the point of C, the transverse width of the guide column accelerates so as to open the shutter members 21 rapidly. To disconnect the plug fitting section 411 from the receptacle fitting section 62, the receptacle connector 2 is disconnected from the plug connector 3. That is to say, when the plug connector 3 is lifted up from the receptacle connector 2, the guide pins 63 come out of the receiving space 423 and the shutter member 21 is closed to be driven by the spring 25. Especially, the step portions 433 can prevent the shutter sheet 21*a* from coming into collision with the shutter sheet 21*b* and resulting in suffering destruction as a result of release of the spring 25. Otherwise, the sliding pieces 211 can cushion the collision between the shutter sheets 21*a*, 21*b* for sliding on the contact pieces 223.

Figure 10:
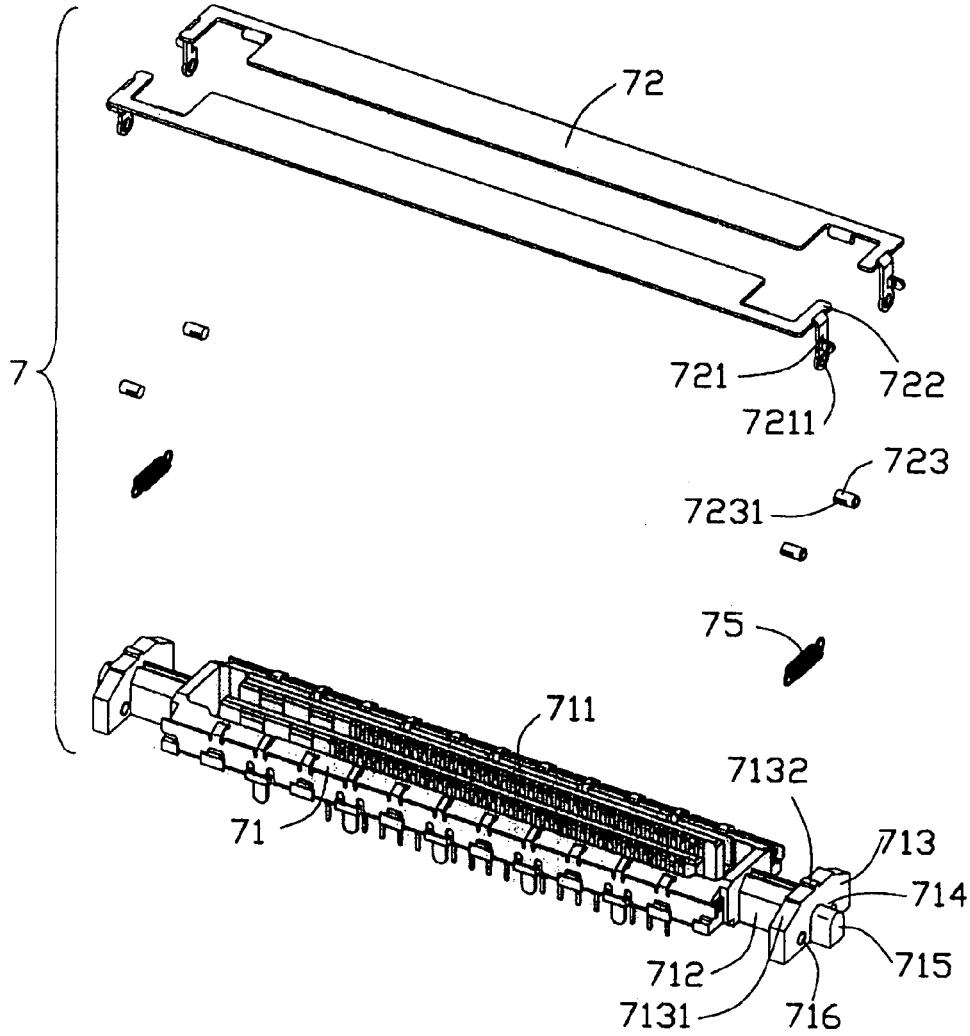
FIG. 10 is a partially exploded perspective view of a receptacle connector according to the second embodiment of the present invention.

Referring to FIGS. 10–13, an electrical connector assembly according to the second embodiment of the present invention comprises a receptacle connector 7 and a plug connector 8 to be connected to the receptacle connector 7. As shown in FIG. 10, the receptacle connector 7 is similar to the receptacle connector 2 of the first embodiment of the present invention. The receptacle connector 7 comprises a first unitary elongate insulating case 71 and a shutter member 72. The first insulating case 71 comprises a first base portion 711, a pair of neck portions 712 extending from opposite ends of the first base portion 711 and a pair of wall portions 713 extending from the pair of neck portions 712. The shutter member 72 covers a plug fitting section of the first base portion 711. A pair of sliding planes 7131 is respectively provided on sides of the wall portions 713 as the sliding planes 432 in the first embodiment. The difference between the second embodiment and the first embodiment are a stopper 7132, an installing portion 715 and two small holes 716. The stopper 7132 protrudes upwardly from the middle of the pair of sliding planes 7131 on a top of the wall portion 713, against which tail ends 722 of the shutter member 72 abuts when the shutter member 72 is shut so as to prevent suffering collision. The installing portion 715 protrudes outwards from an outside 714 of the wall portion 713 and the two small holes 716 are provided at two sides of the installing portion 715 on the outside 714. The two small holes 716 connect pivot holes 7211 on free ends of mating arms 721 of the shutter member 72 by way of agnails 7231 of shafts 723 being linked to the small holes 716, as a result, the shutter member 72 rotate about the shafts 723.

Figure 11:
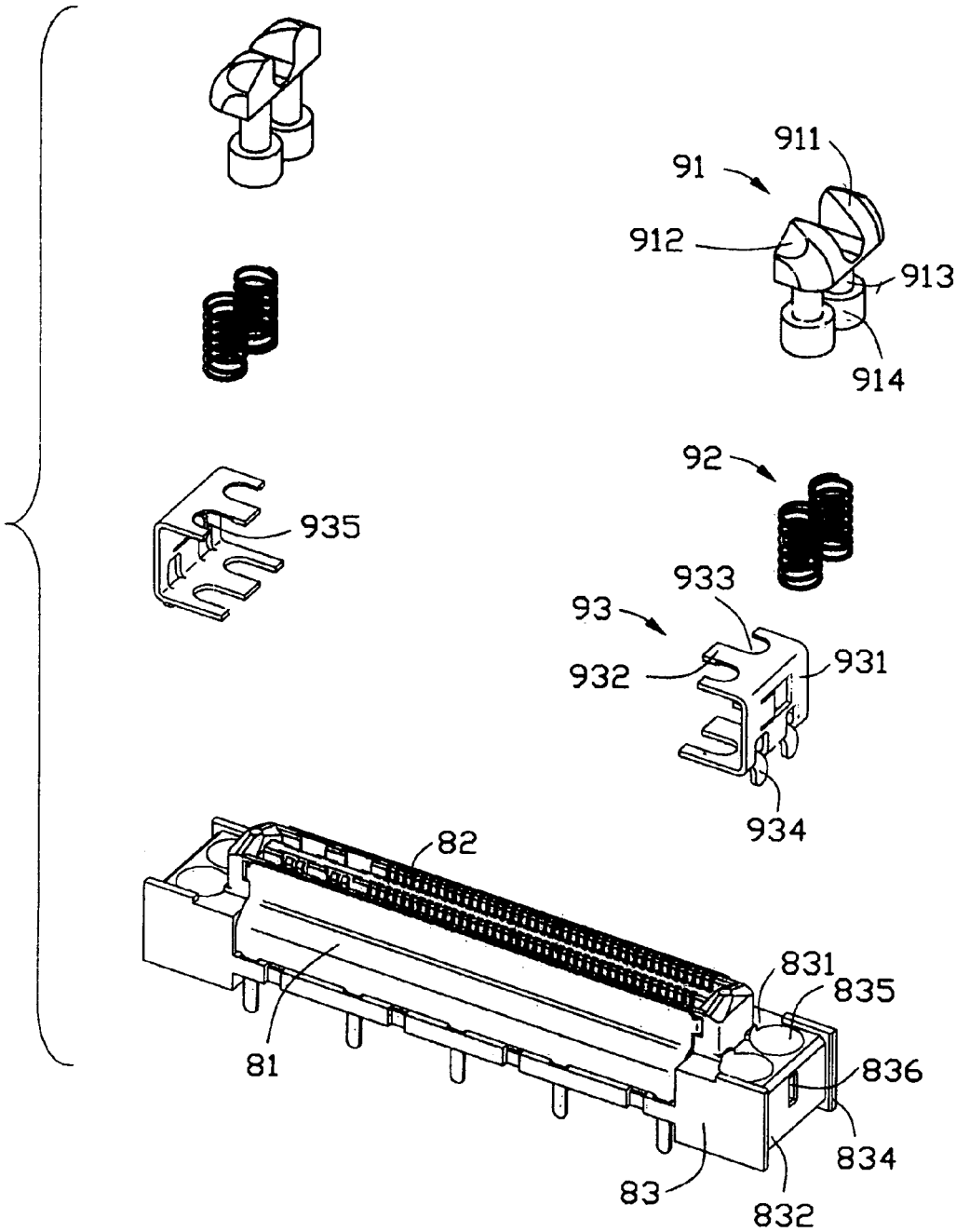
FIG. 11 is a partially exploded perspective view of a plug connector according to the second embodiment of the present invention.
Figure 12:
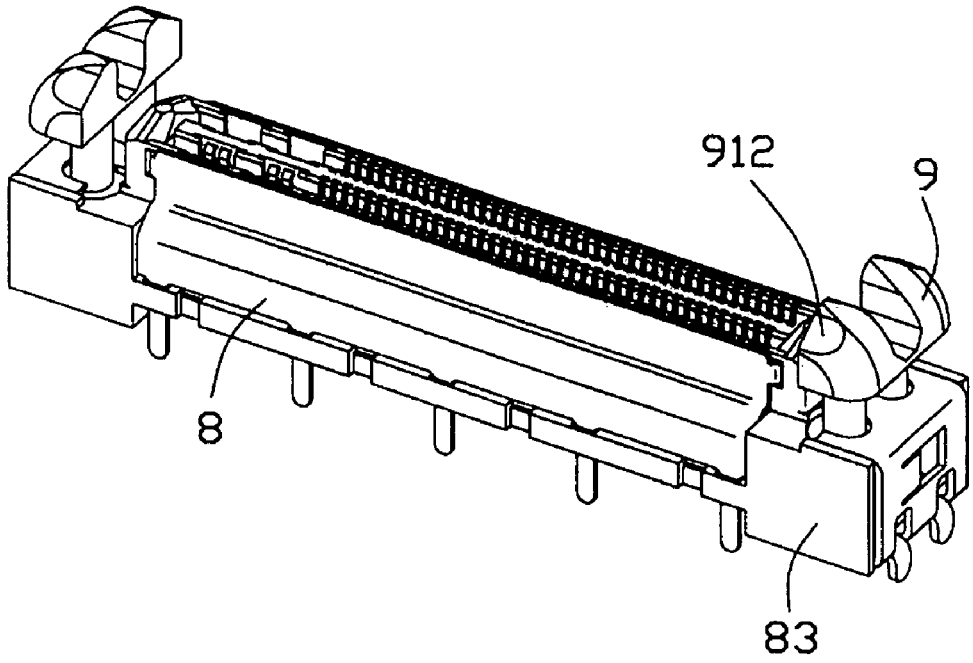
FIG. 12 is an assembled perspective view of FIG. 11 illustrating the guide devices of the plug connector are in freedom.
Figure 13:
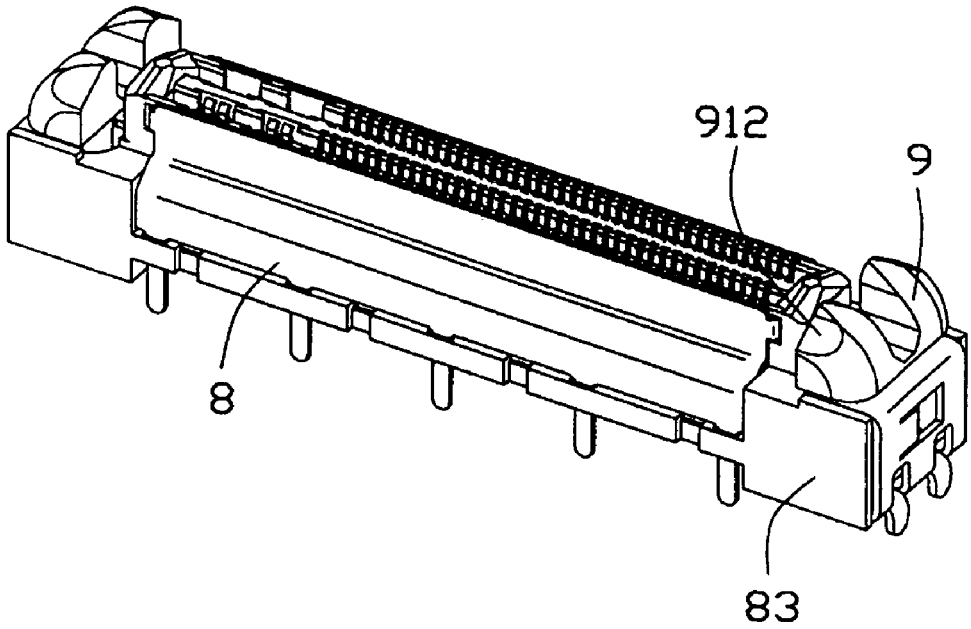
FIG. 13 is an assembled perspective view of FIG. 11 illustrating the guide devices of the plug connector are pressed.

Referring to FIGS. 11–13, the plug connector 8 is similar to the plug connector 3 of the first embodiment and which comprises a second base portion 81 and a receptacle fitting section 82 extending upwardly from the second base portion 81. However, guide devices 9 of the second embodiment are different from the guide devices 63 of the first embodiment of the present invention. The guide devices 9 are mounted on a pair of fixing portions 83 provided on opposite ends of the second base portion 81 and the pair of fixing portion 83 is adjacent to the receptacle fitting section 82. On the one hand, the fixing portion 83 comprises a top surface 831, a bottom (not figured) and an outside surface 832 perpendicular to the top surface 831 at edges of which are provided flanges 834. Otherwise, two fixing-holes 835 penetrate from the top surface 831 to the bottom of the fixing portion 83 and a dint 836 is provided on the outside surface 832. On the other hand, the guide device 9 comprises a guide pin 91, two springs 92 and a metal piece 93. The guide pin 91 comprises a pair of separate guide columns 911 with guide faces 912 at the foreparts thereof and a first column 913 extending downwardly from the bottom of the guide columns 911 to a second column 914 of tubular shape, diameter of the second column 914 is larger than that of the first column 913. Each of the springs 92 located between the fixing portion 83 and the second column 914, one end of the spring 92 is received in the corresponding fixing-hole 835 of the fixing portion 83 and the other end of the spring member 92 is received in the second column 914. The metal piece 93 comprises a main portion 931, a pair of securing potions 932 at a top of the main portion 931 forming a pair of openings 933, a pair of contact portions 934 protruding downwardly from the main portion 931 and a securing piece 935 by pressing. The securing portions 932 moveably secure on the first column 913, and because the diameter of the fixing-holes 835 is substantially equal to that of the second column 914 and is larger than that of the first column 913 so that the securing portions 933 prevent the second column 914 from elastically moving out of the fixing-hole 835. In assembly, firstly, the two springs 92 are mounted into the two fixing-holes 835. Secondly, the first and second columns 913, 914 of the guide pin 91 are mounted into the two fixing-holes 835 and the above half part of the springs 92 are received into the tubular columns 914 (not figured). Lastly, the metal piece 93 are mounted onto the fixing portion 83 by the securing piece 935 being secured into the dint 836 and are prevented from transversely moving by the flanges 834.

When the plug connector 8 does not connect with the receptacle connector 7, the guide pins 91 are in freedom. When the plug connector 8 is brought closer to the receptacle connector 7, the guide device 9 enters into the openings of the shutter member 72, while the guide pins 91 open the shutter member 72, the springs 92 are compressed to complete the connection between the plug connector 8 and the receptacle connector 7. When the plug connector 8 is brought away from the receptacle connector 7, the guide pins 91 protrude against the springs 92 by the first columns 913 going through the openings 933, however, the second columns 914 are resisted by the edges of the openings 933.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a receptacle connector comprising:

a first insulating case defining a longitudinal direction and comprising a first base portion having a plug fitting section and a neck portion extending from at least one end of the first base portion along the longitudinal direction, a width of the neck portion perpendicular to the longitudinal direction being smaller than a corresponding width of the first base portion, a receiving space being formed between the neck portion and the first base portion;

a plurality of first electrical contacts received in the plug fitting section of the first insulating case; and a shutter member mounted on the first insulating case and movably closing and opening the plug fitting section of the first insulating case, the shutter member comprising at least one opening communicating with the receiving space to always expose the neck portion; and a plug connector comprising:

a second insulating case comprising a second base portion, a receptacle fitting section extending from the second base portion and a guide device extending from at least one end of the second base portion adjacent to the receptacle fitting section, the guide device being of a saddle shape and being engageable with the neck portion upon extending through the opening into the receiving space to drive the shutter member open the plug fitting section; and a plurality of second electrical contacts received in receptacle section of the second insulating case and electrically matable with the first electrical contacts;

wherein the shutter member comprises a pair of shutter member halves; and wherein the guide device comprises a pair of guide columns spaced from each other;

wherein the neck portion comprises a pair of slanted first guide faces; and wherein the guide columns comprise a pair of slanted second guide faces corresponding to the first guide faces.

2. The electrical connector assembly according to claim 1, wherein the shutter member is formed with a guide piece extending into the receiving space.

3. The electrical connector assembly according to claim 2, wherein the first insulating case comprises a wall portion extending outwards from the neck portion.

4. The electrical connector assembly according to claim 3, wherein the shutter member comprises a pivot arm and the wall portion comprises shafts secured with the pivot arms.

5. The electrical connector assembly according to claim 4, further comprising a spring, and the pivot arm of the shutter member comprises a locking portion connecting with the spring.

6. An electrical connector comprising:

an insulating case comprising a base portion having a plug fitting section and at least one neck portion extending from at least one end of the base portion, a width of the neck portion being smaller than a corresponding width of the base portion, a receiving space being formed between the neck portion and the base portion;

a plurality of electrical contacts received in the plug fitting section extending within the base portion of the insulating case; and a shutter member mounted to the insulating case and being movable with respect to the insulating case to open and close the plug fitting section of the insulating case;

wherein the neck portion comprises a pair of slanted first guide faces;

wherein the shutter member comprises an opening communicating with the receiving space;

wherein the shutter member comprises a pivot arm having a pivot hole; and wherein the insulating case comprises a wall portion having a shaft extended into the receiving space and engaging with the pivot hole of the pivot arm.

7. An electrical connector assembly comprising:

a first connector including:

an insulating case comprising a base portion, a receptacle fitting section extending from the base portion, and a guide device extending from the base portion and adjacent to the receptacle fitting section, the guide device being of a saddle shape; and a plurality of electrical contacts received in the receptacle fitting section of the insulating case;

wherein the guide device comprises a pair of guide columns arranged at intervals and each of the guide columns is provided with a guide face;

wherein the base portion comprises a fixing portion defining a pair of fixing-holes, the guide device is mounted on the fixing portion and can flex in the fixing-holes of the fixing portion;

wherein each of the guide columns comprises a first column and a second column of tubular shape received in the fixing hole;

wherein the guide device comprises a spring member being between the fixing portion and the second column, one end of the spring member is received in the corresponding fixing-hole of the fixing portion and the other end of the spring member is received in the second column; and wherein the guide device comprises a metal piece fixing on the fixing portion of the insulating case and having a pair of securing portions secured with the guide columns.

8. The electrical connector assembly according to claim 7, wherein the securing portions moveably secure on the first column, and wherein the diameter of the fixing-holes is substantially equal to that of the second column and is larger than that of the first column so that the securing portions prevent the second column from elastically moving out of the fixing-hole.

9. The electrical connector assembly according to claim 7, further including a second connector wherein said second connector defines another insulating case comprising a base portion with a plug fitting section extending therefrom, a neck portion adjacent to said plug fitting section, and a pair of shutters moveably mounted to said another insulating case, wherein said guide device rides upon the neck portion when said first connector and said second connector are mated.

10. The electrical connector assembly according to claim 9, wherein said pair of shutters define a pair of engagement sections spaced from each other with a distance for respective engagement with two lateral sides of the guide device during splitting said pair of shutters away from each other.

* * * * *